US006695306B2

(12) United States Patent
Kaya et al.

(10) Patent No.: US 6,695,306 B2
(45) Date of Patent: Feb. 24, 2004

(54) SHEET MATERIAL CONVEYING APPARATUS WITH HEIGHT-ADJUSTABLE POCKETS

(75) Inventors: Mehmet Oktay Kaya, Lee, NH (US); Heiner Phillipp Luxem, Durham, NH (US); Glenn Alan Guaraldi, Kingston, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 46 days.

(21) Appl. No.: 10/179,334

(22) Filed: Jun. 24, 2002

(65) Prior Publication Data

US 2003/0234154 A1 Dec. 25, 2003

(51) Int. Cl.[7] ..... B65H 29/00
(52) U.S. Cl. ..... 271/187; 271/294; 270/52.2
(58) Field of Search ..... 271/187, 314, 271/315, 81, 294, 223, 903; 270/52.2, 52.19, 58.19, 47

(56) References Cited

U.S. PATENT DOCUMENTS 4,871,159 A * 10/1989 Petersen ..... 270/52.19
5,251,888 A 10/1993 Eugster ..... 270/55
5,823,320 A * 10/1998 Seidel et al. ..... 198/803.5
5,911,416 A * 6/1999 Klopfenstein ..... 271/223
5,921,538 A * 7/1999 Schlough ..... 270/52.18
6,390,469 B1 5/2002 Jones et al. ..... 271/294
6,612,567 B1 * 9/2003 Kaya ..... 271/206

* cited by examiner

*Primary Examiner*—Donald P. Walsh
*Assistant Examiner*—Kenneth W Bower
(74) *Attorney, Agent, or Firm*—Davidson, Davidson & Kappel, LLC

(57) ABSTRACT

A sheet material conveying apparatus includes a plurality of pockets running along a track, each pocket including a setting device for adjusting a height of the pocket so as to define a set height. At least one setting actuator located to a side of the pockets is provided, with the setting actuator being selectively movable between a first position where the setting actuator contacts the setting device for adjusting the setting device when the pockets are stationary and a second position where the setting actuator is free from the setting device to allow movement of the pockets along the track.

13 Claims, 2 Drawing Sheets

SHEET MATERIAL CONVEYING APPARATUS WITH HEIGHT-ADJUSTABLE POCKETS

BACKGROUND OF THE INVENTION

The present invention relates generally to a sheet conveying apparatus, for example, for conveying newspapers, and more particularly to a sheet conveying apparatus having pockets moving on a track. The present invention also relates to such pockets and to a method for setting a bottom of such pockets.

U.S. Pat. No. 5,911,416 describes a sheet material conveying apparatus with a plurality of pockets moveable around a track to accept sheet material from sheet material feeders. These pockets permit for example a first outer section of a newspaper to first be fed into the pockets by a first sheet material feeder, and then an inner newspaper section to be inserted between the folds of the first outer newspaper section.

The apparatus of the '416 patent uses a lift cam 20 to move a semicircular actuator gear 150 to rotate a drive shaft 110 so as to set a height for pocket feet 90 arranged on racks 80. A pawl and rachet mechanism prevents the pocket from opening. The sheet material can then be accepted and inserted into the pockets.

To deliver the sheet material, the pawl and ratchet mechanism can then be released by a trip cam. Tracks move to a lower position through a biasing spring, so that feet release through operation of a driver cam. The sheet material in the pocket can thus move out of the pocket from the bottom to be further conveyed or to be stacked.

U.S. Pat. No. 5,251,888 purports to describe pockets moveable along an endless path. Each pocket is provided with two vertically adjustable stops mounted displaceably in a pocket carrier. A guide member purportedly can be set to vertically adjust the stops as the pockets are moved along the endless path.

These patents do not provide setting devices directly on the pockets for setting when the pockets are stationary.

Commonly-assigned U.S. Pat. No. 6,390,469 discloses a sheet material conveying apparatus including a plurality of pockets, with each pocket having a setting device for adjusting a height of the pocket when the pocket is stationary, with the setting device including a setting rod, a ring gear and a lock ring. U.S. Pat. No. 6,390,469 is incorporated by reference herein.

BRIEF SUMMARY OF THE INVENTION

The present invention provides a sheet material conveying apparatus comprising:

- a plurality of pockets running along a track, each pocket including a setting device for adjusting a height of the pocket so as to define a set height, and
- at least one setting actuator located to a side of the pockets, the setting actuator being selectively movable between a first position where the setting actuator contacts the setting device for adjusting the setting device when the pockets are stationary and a second position where the setting actuator is free from the setting device to allow movement of the pockets along the track.

Preferably, the pockets are spaced apart by a spacing distance and the at least one setting actuator includes a plurality of setting actuators spaced apart by the spacing distance.

The apparatus preferably further includes a movable base for the plurality of setting actuators to provide the first and second positions.

The pockets preferably include a bottom, the bottom being connected to the setting device for adjusting the height. The bottom may be spring-loaded in a closed position, and a cam follower may be provided to permit opening of the bottom to deliver the sheet material.

The setting device may include at least two slide gears, the bottom preferably being rotatably supported in the slide gear. The slide gears may have a toothed side, and a toothed gear may interact with the toothed side to set the pocket height. The pockets may include a frame, and the slide gears move slidably with respect to the frame.

The toothed gear preferably has a clutch mechanism for interacting with a matching clutch mechanism of the actuator. The clutch mechanism can take any desired shape, such as a friction cone or key-keyhole, and need merely be functional to provide movement of the setting device using the setting actuator.

The setting actuators may be motor operated.

Preferably, a plurality of setting actuators are provided.

The present invention permits the pockets to be set with automatically without complex devices located on each pocket.

The present invention also provides a method for setting a height of a sheet material pocket comprising the steps of:

- moving a plurality of pockets along a track, each pocket including a setting device for adjusting a height of the pocket;
- stopping the plurality of pockets;
- moving at least one setting actuator to contact the setting device of a first pocket of the plurality of pockets while the first pocket is stationary;
- setting the first pocket to a set height using the setting actuator; and
- removing the setting actuator from the setting device.

Preferably, the method further includes moving the pockets further along the track, restopping the pockets and setting a second pocket to the set height using the setting actuator.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
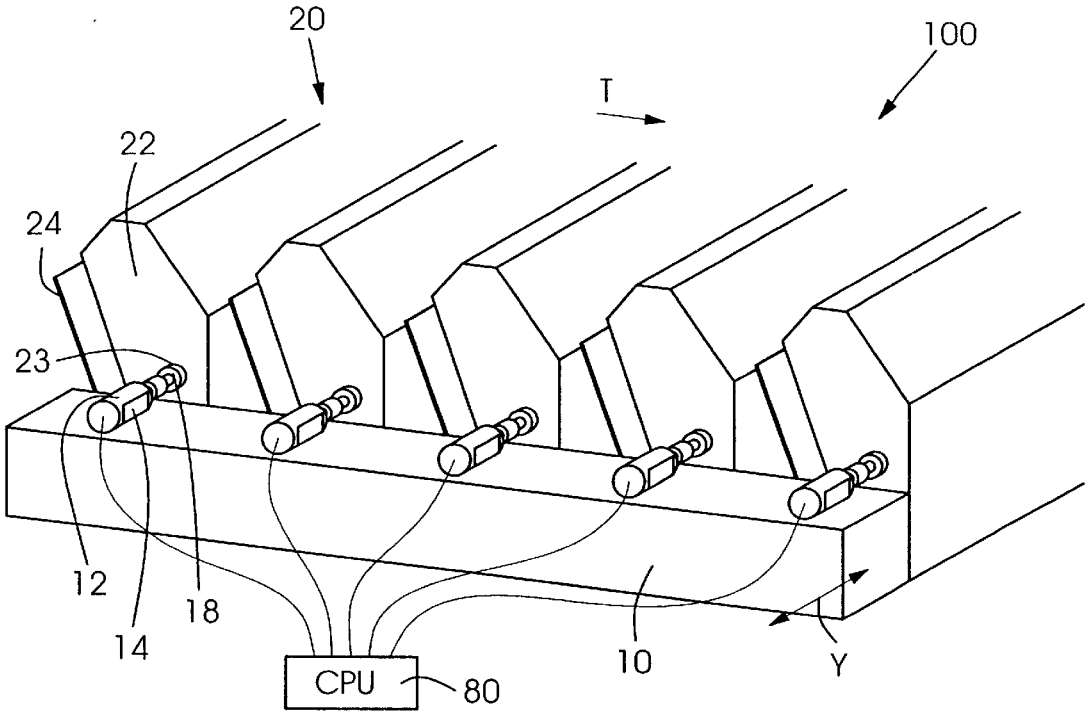
FIG. 1 shows a schematic view of a sheet material conveying apparatus according to the present invention.

FIG. 1 shows a schematic view of a sheet material conveying apparatus 100 having an endless track for transporting a plurality of pockets 20 in direction 17. Each pocket 20 includes a frame 22 with a pocket back 24, which may for example be fixed with respect to frame 22.

A plurality of setting actuators 12 may be fixed to a movable base 10, via for example, connectors 14. Actuators 12 may include electric motors, for example, and controlled by a processor 80. Actuators 12 can, in one mode, axially retract and extend the output shaft so that actuators 12 can selectively connect to a setting device of pocket 20, for example through a clutch mechanism 18 that fits through a hole 23 in frame 22. Alternately, base 10 may be movable in direction Y by a motor.

Figure 2:
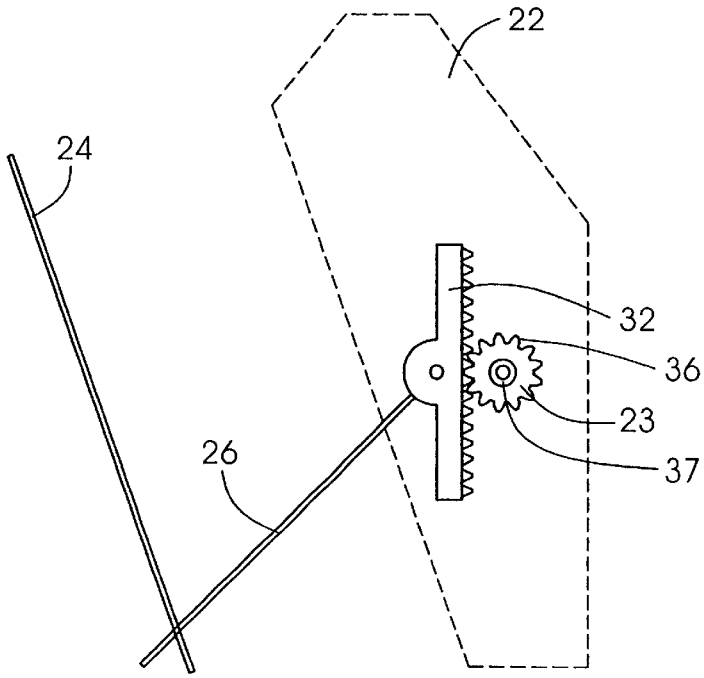
FIG. 2 shows a partial side view of a pocket according to the present invention, with certain elements omitted for clarity purposes.

As shown in FIG. 2, the setting device for pocket 20 includes a gear 36, which has an interior clutch mechanism 37 for interacting with clutch mechanism 13 of actuator 12. Gear 36 can be rotated to move a slide gear 32 up and down. A pocket bottom 26, which can be fingered to pass through cut-outs in back 24, is supported in slide gear 32 in a spring-loaded fashion to be forced normally to the closed position shown in FIG. 2.

Figure 3:
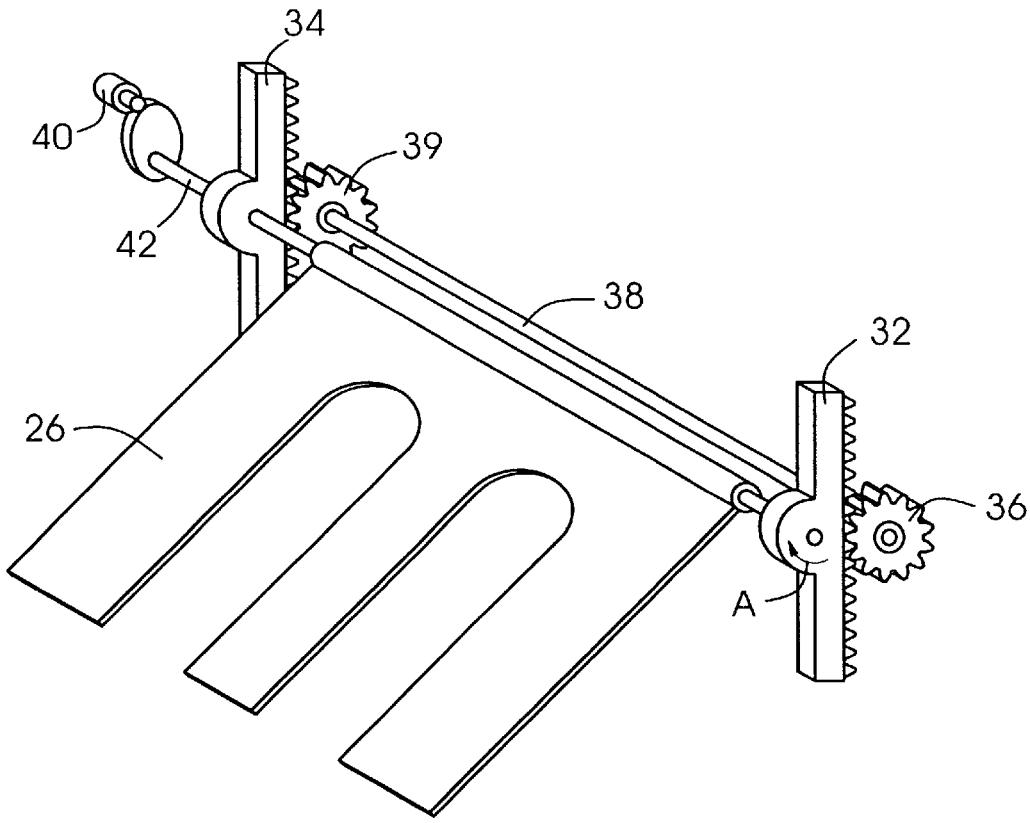
FIG. 3 shows a partial perspective view of a pocket according to the present invention with certain elements omitted for clarity purposes.

As shown in FIG. 3, bottom 26 is spring-loaded in direction A, or the closed position.

Thus, as sheet material is deposited in pockets 20, the height of the pocket is determined by the position of slide gears 32 and 34, which are movable with respect to frame 22 and thus back 24. Slide gears 32 and 34 may fit into frame 22 as described in U.S. Pat. No. 6,390,469.

Gears 36 and 39 may be connected by an axle 38, so that slide gears 32, 34 move in tandem.

To release sheet material in pockets 20, a cam follower 40 may be provided, so that as cam follower 40 is forced downwardly by a cam, a force counter to the spring loading of bottom 26 and direction A is created to open the bottom and drop the sheet material from the pocket 20. When the cam action stops, bottom 26 is again returned to the same position as set by the setting device.

Figure 4:
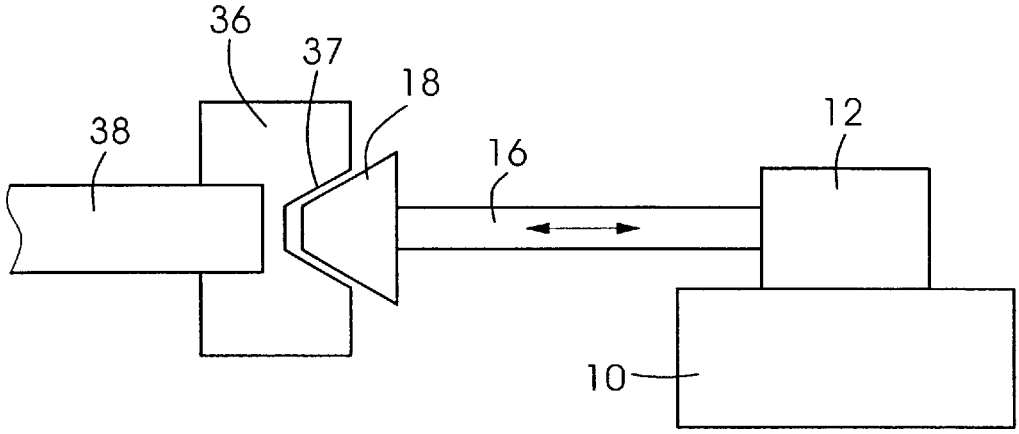
FIG. 4 shows a schematized side view of the setting actuator and part of the setting device of the present invention.

FIG. 4 shows an output shaft 16 of actuator 12 between a first position where clutch mechanism 37 of the setting device interacts with clutch mechanism 18 of setting actuator 12. Clutch mechanism 37 may be an interior conical area with a friction coating, and clutch mechanism 18 a cone with a friction coating.

The conveying apparatus of the present invention provides an effective way to change the pockets height of a plurality of pockets. The apparatus may have, for example 200 pockets, and base 10 a set of five actuators. To reset a pocket height, pockets 20 are stopped. Controller 80 moves actuators 12 to contact setting devices of five pockets 20. The actuators 12 then rotate the gears 36 by a predetermined amount, so that a new pocket height is set. Controller 80 then moves actuators 12 to disengage pockets 20. Pockets 20 are then moves along their track T until five new pockets 20 are located beside base 10, and base 10 is moved so that actuators 12 engage the five new pockets 20. The setting process is then repeated, until all 200 pockets 20 are reset to a new height. The apparatus may then function to receive new sheet material at the reset height.

What is claimed is:

1. A sheet material conveying apparatus comprising:

a plurality of pockets running along a track, each pocket including a setting device for adjusting a height of the pocket so as to define a set height, and at least one setting actuator located to a side of the pockets, the setting actuator being selectively movable between a first position where the setting actuator contacts the setting device for adjusting the setting device when the pockets are stationary and a second position where the setting actuator is free from the setting device to allow movement of the pockets along the track.

2. The apparatus as recited in claim 1 wherein the pockets are spaced apart by a spacing distance and the at least one setting actuator includes a plurality of setting actuators spaced apart by the spacing distance.

3. The apparatus as recited in claim 2 further comprising a movable base for the plurality of setting actuators to provide the first and second positions.

4. The apparatus as recited in claim 1 wherein the pockets include a bottom, the bottom being connected to the setting device for adjusting the height.

5. The apparatus as recited in claim 4 wherein the bottom is spring-loaded in a closed position, and each pocket further includes a cam follower to permit opening of the bottom to deliver the sheet material.

6. The apparatus as recited in claim 1 wherein the setting device includes at least two slide gears.

7. The apparatus as recited in claim 6 wherein the pocket includes a bottom rotatably supported in the slide gears.

8. The apparatus as recited in claim 7 wherein the slide gears have a toothed side, and the setting mechanism includes a toothed gear interacting with the toothed side to set the pocket height.

9. The apparatus as recited in claim 1 wherein the setting device includes a clutch mechanism for interacting with a matching clutch mechanism of the actuator.

10. The apparatus as recited in claim 1 wherein the setting actuator is motor operated.

11. The apparatus as recited in claim 1 wherein the at least one setting actuator includes a plurality of actuators.

12. A method for setting a height of a sheet material pocket comprising the steps of:

moving a plurality of pockets along a track, each pocket including a setting device for adjusting a height of the pocket;

stopping the plurality of pockets;

moving at least one setting actuator to contact the setting device of a first pocket of the plurality of pockets while the first pocket is stationary;

setting the first pocket to a set height using the setting actuator; and removing the setting actuator from the setting device.

13. The method as recited in claim 12 further comprising moving the pockets further along the track, restopping the pockets and setting a second pocket to the set height using the setting actuator.

* * * * *